US007171147B2

(12) United States Patent
Cormier et al.

(10) Patent No.: US 7,171,147 B2
(45) Date of Patent: Jan. 30, 2007

(54) DOUBLE-SLEEVED ELECTROSTATOGRAPHIC ROLLER

(75) Inventors: Steven O. Cormier, West Henrietta, NY (US); Dennis J. Grabb, Sodus, NY (US); Ralph E. Williams, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 294 days.

(21) Appl. No.: 10/965,642

(22) Filed: Oct. 14, 2004

(65) Prior Publication Data

US 2005/0111889 A1 May 26, 2005

Related U.S. Application Data

(60) Provisional application No. 60/523,790, filed on Nov. 20, 2003.

(51) Int. Cl.
*G03G 15/16* (2006.01)

(52) U.S. Cl. ..... 399/308

(58) Field of Classification Search ..... 399/302, 399/308, 117, 313
See application file for complete search history.

(56) References Cited

U.S. PATENT DOCUMENTS

| | | | | |
|---|---|---|---|---|
| 4,144,812 | A | 3/1979 | Julian | |
| 5,084,735 | A | 1/1992 | Rimai et al. | |
| 5,187,526 | A | 2/1993 | Zaretsky | |
| 5,298,956 | A | 3/1994 | Mammino et al. | |
| 5,335,054 | A | 8/1994 | Landa et al. | |
| 5,370,961 | A | 12/1994 | Zaretsky et al. | 430/126 |
| 5,409,557 | A | 4/1995 | Mammino et al. | 156/137 |
| 5,415,961 | A | 5/1995 | Yu et al. | 430/58 |
| 5,701,567 | A | 12/1997 | Bucks et al. | 399/302 |
| 5,715,505 | A | 2/1998 | Tombs et al. | 399/299 |
| 5,732,311 | A | 3/1998 | May et al. | 399/159 |
| 5,745,829 | A | 4/1998 | Gazit et al. | 399/302 |
| 5,828,931 | A | 10/1998 | May et al. | 399/159 |
| 5,894,796 | A | 4/1999 | Gelinas | 101/219 |
| 6,259,873 | B1 | 7/2001 | Shifley et al. | 399/110 |
| 6,263,177 | B1 | 7/2001 | Shifley et al. | 399/110 |
| 6,377,772 | B1 * | 4/2002 | Chowdry et al. | 399/302 |
| 6,393,249 | B1 | 5/2002 | Aslam et al. | 399/333 |
| 6,394,943 | B1 | 5/2002 | Cormier et al. | 492/47 |
| 6,484,002 | B2 | 11/2002 | Shifley et al. | 399/110 |
| 6,567,641 | B1 | 5/2003 | Aslam et al. | 399/330 |
| 6,605,399 | B2 | 8/2003 | Chowdry et al. | 430/62 |

* cited by examiner

*Primary Examiner*—Susan Lee
(74) *Attorney, Agent, or Firm*—Lawrence P. Kessler

(57) ABSTRACT

A double-sleeved roller (DSR) including: a mandrel having a disconnectable end incorporating three termination plates having specified axial profiles; a replaceable inner sleeve member (ISM) mounted on the mandrel; and, a replaceable multilayer outer sleeve member (OSM) including at least one synthetic layer with the OSM surrounding the ISM. The mandrel, adapted to support a non-reinforced ISM, includes the termination plates joined together so as to define two sets of channels for selectively conveying pressurized air to either OSM or ISM for radial expansion thereof. The termination plates have specialized outer shapes, with each termination end plate including a cylindrical portion adjoining a tapered portion. For removal and/or replacement of the OSM or the ISM, a removable support member is moved away from the disconnectable end of the roller while the other end of the roller continues to be supported in cantilever fashion.

24 Claims, 8 Drawing Sheets

DOUBLE-SLEEVED ELECTROSTATOGRAPHIC ROLLER

CROSS-REFERENCE TO RELATED APPLICATIONS

This application claims the benefit of Provisional application Ser. No. 60/523,790, filed Nov. 20, 2003. Reference is made to the following commonly assigned application, the disclosure of which is incorporated herein by reference:

U.S. patent application Ser. No. 10/965,412, filed on even filing date herewith, by Steven O. Cormier, et al., entitled, "FIXTURE FOR MOUNTING A SLEEVE MEMBER ON A MANDREL";

FIELD OF THE INVENTION

The invention relates to electrostatography and to electrostatographic roller apparatus, and in particular to a double-sleeved roller including a novel mandrel with replaceable inner and outer sleeve members mounted concentrically thereon.

BACKGROUND OF THE INVENTION

Usage of compliant rollers in electrophotographic apparatus is well known, which compliant rollers may incorporate a removable sleeve member mounted concentrically around a mandrel. Single-sleeved and double-sleeved compliant rollers have been disclosed, e.g., sleeved imaging rollers, sleeved intermediate transfer rollers, and sleeved rollers for use in a fusing station. Thus in an electrostatographic machine employing a sleeved roller, a toner image is typically formed on an imaging member, transferred in a first transfer operation from the imaging member to an intermediate transfer member, and subsequently transferred in a second transfer operation from the intermediate transfer member to a receiver member (e.g., paper), whereupon the toner image on the receiver is fixed thereon in a fusing station.

Compliant intermediate transfer rollers have for example been disclosed in the Rimai, et al. patent (U.S. Pat. No. 5,084,735), the Zaretsky and Gomes patent (U.S. Pat. No. 5,370,961), the Zaretsky patent (U.S. Pat. No. 5,187,526) and the Bucks, et al. patent (U.S. Pat. No. 5,701,567). In these exemplary patents a compliant intermediate transfer roller includes a central member to which is adhered a coating of a thick compliant layer having a relatively thin hard overcoat, which roller improves the quality of electrostatic toner transfer from an imaging member to a receiver as compared to a non-compliant intermediate roller.

The use of a removable endless belt or tubular type of blanket on an intermediate roller has long been practiced in the offset lithographic printing industry. As disclosed, for example, in the Julian patent (U.S. Pat. No. 4,144,812) an intermediate lithographic roller comprises a portion having a slightly smaller diameter than the main body of the roller, such that a blanket member may be slid along this narrower portion until it reaches a location where a set of holes located in the roller allow a fluid under pressure, e.g., pressurized air, to pass through the holes, thereby stretching the blanket member and allowing the entire blanket member to be slid onto the main body of the roller. After the blanket is located in a suitable position, the source of pressurized air or fluid under pressure is turned off, thereby allowing the blanket member to relax to a condition of smaller strain, such strain being sufficient to cause the blanket member to snugly embrace the roller. The Gelinas patent (U.S. Pat. No. 5,894,796) discloses that the tubular blanket may be made of materials including rubbers and plastics and may be reinforced by an inner layer of aluminum or other metal.

An intermediate transfer roller having a rigid core and a removable, replaceable intermediate transfer blanket has been disclosed in Landa, et al. (U.S. Pat. No. 5,335,054), and in Gazit, et al. (U.S. Pat. No. 5,745,829), whereby the intermediate transfer blanket is fixedly and replaceably secured and attached to the core. The intermediate transfer blanket includes a substantially rectangular sheet mechanically held to the core by grippers. The core (or drum) has recesses where the grippers are located. It is disadvantageous that the entire circumference of the intermediate transfer drum cannot be utilized for transfer because the blanket does not form a continuous covering of the core surface. Moreover, particulate contamination tends to collect in the unavoidable gap between the ends of the blanket.

An electrostatographic imaging member in the form of a removable replaceable endless imaging belt on a rigid roller is disclosed in Yu, et al. (U.S. Pat. No. 5,415,961). The electrostatographic imaging member is placed on the rigid roller and removed from the rigid roller by stretching the endless imaging belt with a pressurized fluid.

The Mammino, et al. patents (U.S. Pat. Nos. 5,298,956 and 5,409,557) disclose a reinforced seamless intermediate transfer member that may be in the shape of a belt, sleeve, tube or roll and including a reinforcing member in an endless configuration having filler material and electrical property regulating material on, around or embedded in the reinforcing member.

The May and Tombs patents (U.S. Pat. Nos. 5,715,505 and 5,828,931) disclose a primary image-forming roller including a thick compliant blanket layer adherently coated on a core member, the thick compliant blanket surrounded by a relatively thin photoconductive structure. The compliant primary imaging roller provides improved electrostatic transfer of a toner image directly to a receiver member. It is further disclosed that the compliant imaging roller can be used bifunctionally, i.e., it may serve as an intermediate member for electrostatic transfer of a toner image to a receiver. The May and Tombs patent (U.S. Pat. No. 5,732,311) discloses a compliant electrographic primary image-forming roller.

The Chowdry, et al. patent (U.S. Pat. No. 6,605,399) discloses a sleeved compliant primary image-forming roller and a method of making such a roller. The sleeve is a photoconductive member, the sleeve resting on a compliant layer coated on a core member. This has certain advantages over U.S. Pat. No. 5,715,505 and U.S. Pat. No. 5,828,931, in that the coatings on the roller are made more reliably and more cheaply, and also in that the photoconductive sleeve may be readily removed and replaced when at the end of its useful life, thereby lowering cost and reducing downtime. The Chowdry, et al. patent (U.S. Pat. No. 6,605,399) also includes an advantage over U.S. Pat. No. 5,415,961 by providing a core member coated by a thick compliant layer over which the sleeve member is placeable and removable. However, in certain embodiments of this Chowdry, et al. patent, the rigid core member is electrically biased to effect transfer of toner, and because the electrical properties of the compliant layer coated on the core member alter with age, the compliant layer has a finite lifetime requiring expensive periodic replacement of the coated core member. Moreover, the compliant layer is disadvantageously subject to damage when removing or replacing a sleeve member, and such damage may necessitate recoating or replacing the costly core member.

The Shifley, et al. patents (U.S. Pat. Nos. 6,259,873, 6,263,177 and U.S. Pat. No. 6,484,002) disclose apparatus including a roller (such as a photoconductive roller or an intermediate transfer roller) which roller has a removable replaceable surface or sleeve, and which roller is supported at one end in cantilevered fashion during sleeve removal or replacement via the other end of the roller. For operation of the roller, the roller is supported at both ends. A disconnectable supportive member is provided that can be disengaged and moved away from the roller so as to provide a free end for purpose of sleeve removal or replacement. This supportive member is moved back so as to engage and support the roller for operation.

The Cormier, et al. patent (U.S. Pat. No. 6,394,943) describes an image transfer drum inclusive of a mandrel having an air bearing to facilitate loading and removal of a resilient sleeve. The air bearing is provided with a pair of cooperating plates one of which is scored with equally spaced and radially extending grooves. When urged together, the plates define a central air chamber and a plurality of radially-extending passages serving to direct pressurized air radially from one end of the mandrel, at which end the sleeve can be removed and replaced. The pressurized air is conveyed to the central chamber via a pipe passing into the mandrel at the other end of the mandrel, at which other end the mandrel is supported in cantilever fashion during removal or replacement of a sleeve.

Advantage over the Chowdry, et al. patent (U.S. Pat. No. 6,605,399) and the Cormier, et al. patent (U.S. Pat. No. 6,394,943) is obtained by providing an electrostatographic double-sleeved roller, as disclosed in the Chowdry, et al. patent (U.S. Pat. No. 6,377,772). Such a type of double-sleeved roller (DSR) can be useful for a number of applications in an electrostatographic machine, for example as a primary image-forming member or as an intermediate transfer member. The DSR includes a cylindrical rigid core member, a replaceable removable multilayer inner sleeve member (ISM) in the shape of an endless tubular belt including at least one compliant layer (e.g., made of a polyurethane) such that the ISM surrounds and nonadhesively intimately contacts the core member, and a replaceable removable multilayer outer sleeve member (OSM) in the shape of an endless tubular belt including at least one synthetic layer such that the OSM surrounds and nonadhesively intimately contacts the ISM. The synthetic layer may include, for example, a plastic, a polymer, a copolymer, an elastomer, a foam, a photoconductive material, a material including filler particles, a material comprising two or more phases, or a material reinforced with fibers. Because of the double-sleeve construction, an accurately dimensioned core member can have a long life without need of replacement. Moreover, the core member can advantageously remain fixed to the electrostatographic apparatus in which it is mounted when a sleeve member is replaced, and in a preferred embodiment either or both OSM and ISM are removable from the same end of the roller. A DSR, as disclosed in the Chowdry, et al. patent (U.S. Pat. No. 6,377,772), has an extra advantage in that a stiffening layer can be included as an exterior outer surface of an ISM or more preferably as an exterior inner surface of an OSM, thereby avoiding certain coating complications, and facilitating mounting and demounting of the sleeves. Additionally, overall operating costs are reduced, inasmuch as either sleeve may be replaced without replacing the other, or else the inner and outer sleeves may be replaced with differing frequencies. Thus an inner or outer sleeve member can easily and independently be replaced on account of wear or damage, or replaced when at the end of a predetermined operational life. An expensive, finely toleranced core member can thereby be retained for long operational usage with many generations of sleeve members.

The Aslam, et al. patents (U.S. Pat. Nos. 6,393,249 and U.S. Pat. No. 6,567,641) disclose double-sleeved rollers for use in a fusing station of an electrostatographic machine, e.g., as fuser rollers, as pressure rollers, or both.

An inner sleeve member (ISM) employed according to the Chowdry, et al. patent (U.S. Pat. No. 6,377,772) includes a flexible high-modulus tubular band, e.g., as a strengthening band or backing layer concentric with and supporting an adhered compliant layer. With the outer sleeve member (OSM) removed, this backing layer facilitates handling of the ISM during its removal or replacement using a pressurized air technique akin to that disclosed in the Julian patent (U.S. Pat. No. 4,144,812). However, to manufacture such a reinforced ISM generally requires a costly coating process. Thus there is a need to reduce manufacturing expense. One solution is to utilize a relatively cheap, non-reinforced, compliant ISM, i.e., an ISM having no high-modulus band or backing layer, such as is disclosed below for inclusion in the present invention. However, a non-reinforced relatively stretchable ISM (not contemplated in the Chowdry, et al. patent (U.S. Pat. No. 6,377,772)) has a propensity to exhibit edge disturbance when the pressurized air technique is used to expand and axially slide the OSM over the ISM (prior to removing the ISM). There is, therefore, a companion need for a specialized mandrel to securely support a non-reinforced ISM during mounting and demounting of an OSM of a double-sleeved roller. Moreover, there is an ancillary need for such a mandrel to provide, at a lower cost than in the prior art, delivery of pressurized air for use with both the ISM and the OSM. To satisfy these needs, the present invention provides a novel double-sleeved roller which includes such a mandrel and such a non-reinforced ISM.

SUMMARY OF THE INVENTION

The present invention, for use in an electrostatographic machine, provides a double-sleeved roller (DSR) including: a novel cylindrically symmetrical mandrel, a replaceable removable inner sleeve member (ISM) in the shape of an endless compliant tubular belt surrounding (and non-adhesively intimately contacting) the mandrel, and a replaceable removable multilayer outer sleeve member (OSM) in the shape of an endless tubular belt including at least one synthetic layer with the OSM surrounding (and non-adhesively intimately contacting) the ISM. The novel mandrel is specifically and particularly adapted to support a non-reinforced ISM. This improved mandrel includes a number of relatively inexpensive members joined together so as to define channels for selectively conveying pressurized air to either of the OSM or the ISM for radial expansion thereof. Furthermore, a preferred embodiment of the improved mandrel includes a single source pipe for providing pressurized air so as to be able to selectively expand either of the two sleeve members.

During operation of the roller, each end of the roller is held in place by a support member. For removal and replacement of the OSM or the ISM, one end of the roller is disconnected from the respective support member and this disconnected support member is moved away while the other end of the roller continues to be supported in cantilever fashion.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Figure 1:
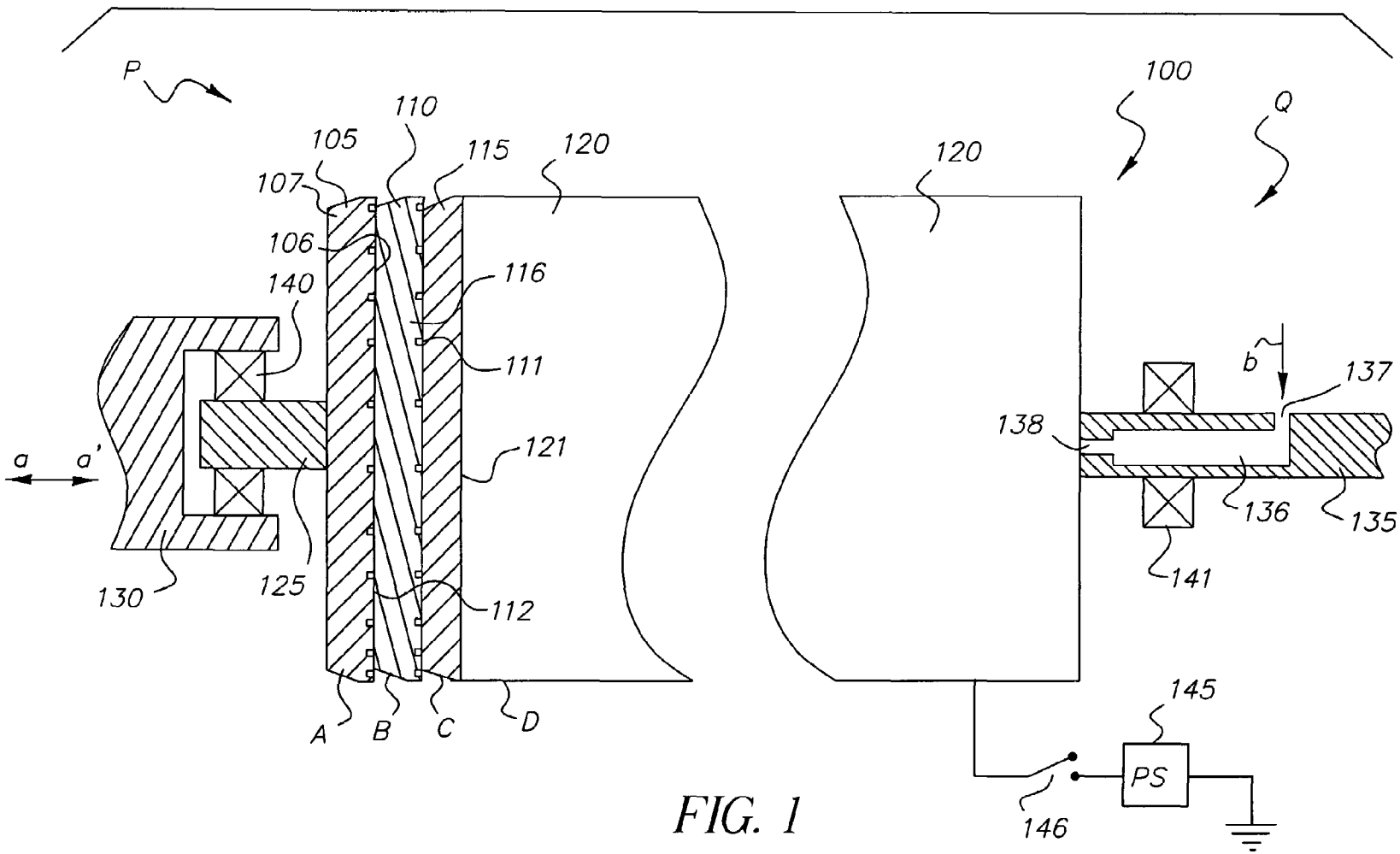
FIG. 1 illustrates a mandrel assembly including a mandrel and mandrel-supporting members for inclusion in a double-sleeved electrostatographic roller of the invention, the mandrel for supporting a replaceable inner sleeve member and a replaceable outer sleeve member mounted around the inner sleeve member.

The present invention provides a double-sleeved roller (DSR) for use in an electrostatographic machine, which DSR has certain advantages over that disclosed in the Chowdry, et al. patent (U.S. Pat. No. 6,377,772). The DSR of the invention includes a generally cylindrically symmetrical mandrel inclusive of a rigid sleeve-supporting member, a replaceable removable inner sleeve member (ISM) in the shape of an endless compliant tubular belt surrounding and nonadhesively intimately contacting the rigid sleeve-supporting member, and a replaceable removable multilayer outer sleeve member (OSM) in the shape of an endless tubular belt including at least one synthetic layer, with the OSM surrounding and nonadhesively intimately contacting the ISM. A disconnectable end of the mandrel incorporates three termination plates having specified axial profiles. During operation of the roller each end of the roller is held in place by a support member. For removal and replacement of the OSM or the ISM, the disconnectable end of the roller is disconnected from the respective support member and this disconnected support member is moved away while the other end of the roller continues to be supported in cantilever fashion.

The ISM has a primary but not necessarily exclusive function of providing compliance. The primary function of the OSM is dictated by the application for which the DSR is used, with the application determining the composition of the layer(s) included in the OSM. In a preferred application, with the OSM inclusive of a photoconductive layer structure, the DSR can be a compliant primary imaging member. Alternatively, the OSM can provide suitable layers for a double-sleeved compliant intermediate transfer member, for a compliant member for use in a fusing station, or for any other suitable type of compliant roller useful in an electrostatographic machine.

The mandrel disclosed in the Chowdry, et al. patent (U.S. Pat. No. 6,377,772), includes a plurality of radial pipes (in the form of bores) for conveying pressurized air from an interior chamber to the inner sleeve member. These pipes are expensive and difficult to fabricate. The mandrel of the invention advantageously provides members which when joined to one another mutually cooperate so as to form radial channels. Thus the mandrel of the invention includes at a disconnectable end a number of relatively inexpensive members having the form of termination plates joined together so as to define two sets of channels for selectively conveying pressurized air to the outer sleeve member (or to the inner sleeve member) for radial expansion thereof. Moreover, each of these termination plates has a specified axial profile. It is important that in a preferred embodiment of the invention the mandrel is specifically adapted to support a non-reinforced inner sleeve member. Furthermore, the mandrel of the present invention reduces complexity of construction by preferably including a single source-pipe for providing pressurized air for expansion of either of the two sleeve members, rather than two source-pipes (one for each sleeve member) as previously disclosed in the Chowdry, et al. patent (U.S. Pat. No. 6,377,772).

Compared with the prior art, a double-sleeved roller of the invention advantageously has reduced costs of manufacturing and of servicing, which lower costs derive primarily from the key features of: (1) the above-mentioned termination plates of the mandrel, (2) preferred use of a relatively cheap inner sleeve member, and (3) improved delivery of pressurized air for use in replacing either or both of the outer and inner sleeve members.

Figure 2:
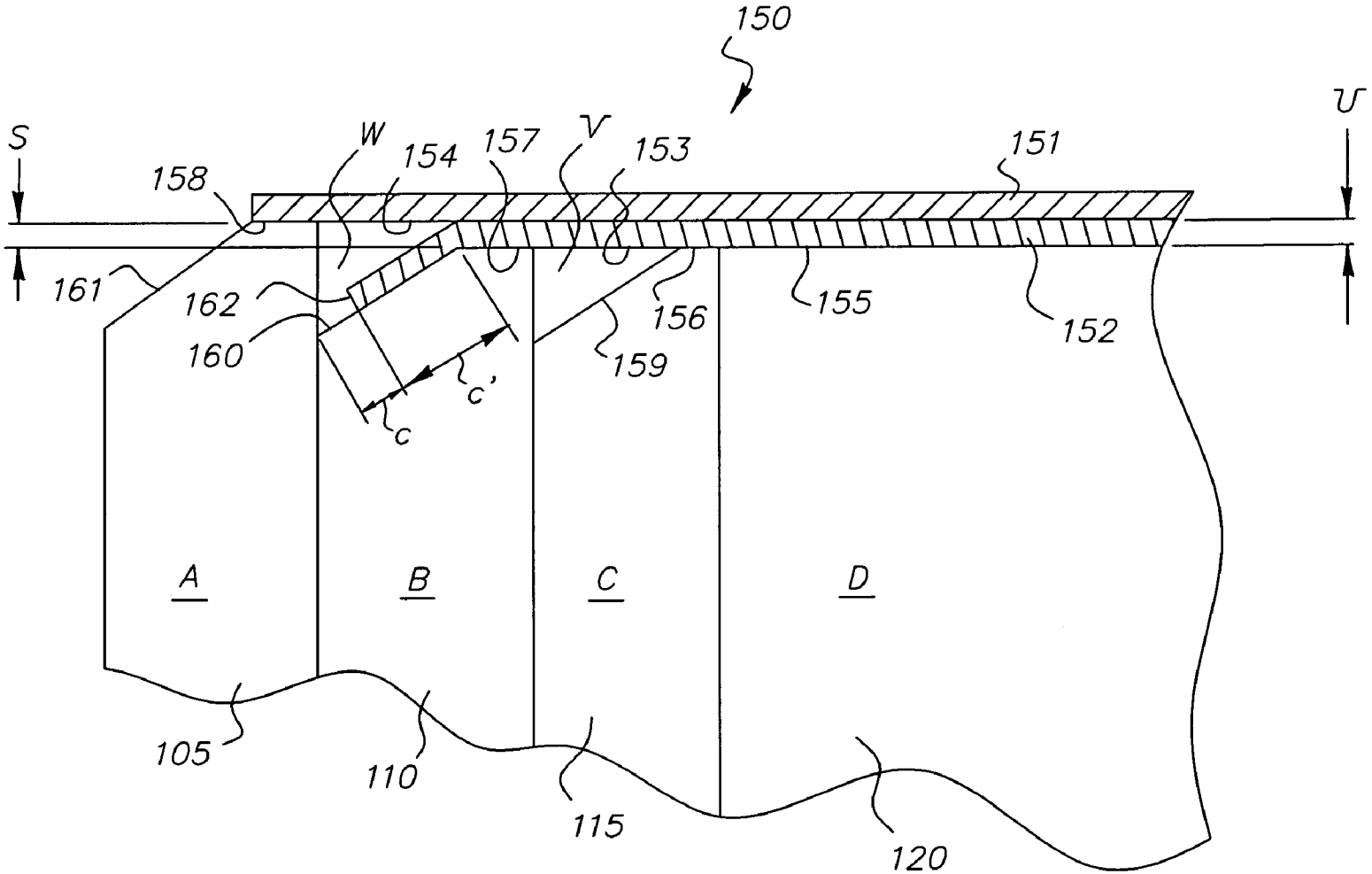
FIG. 2 shows certain details of a double-sleeved roller of the invention including a portion of the mandrel of FIG. 1 as well as edge portions of both the inner and outer sleeve members mounted on the mandrel.

FIGS. 1 and 2, when considered together, are generally representative of a typical double-sleeved roller of the invention. FIG. 1 illustrates, in longitudinal cross-section, a mandrel assembly for use in a double-sleeved roller (DSR) of the invention. FIG. 2 illustrates a portion of the DSR including a removable replaceable inner sleeve member (ISM) and a removable replaceable outer sleeve member (OSM), with the OSM and the ISM shown operationally mounted concentrically on the mandrel of FIG. 1.

Turning now to FIG. 1, a mandrel assembly 100 is depicted, the mandrel assembly including a mandrel and mandrel-supporting members for inclusion in a double-sleeved electrostatographic roller of the invention. The mandrel operationally supports or holds a preferably compliant removable ISM and a removable OSM, with the outer sleeve member mounted around the inner sleeve member (ISM and OSM not shown in FIG. 1). The mandrel of assembly 100 minimally includes a sleeve-supporting member 120 and three successively adjacent termination plates 105, 110, and 115. The mandrel assembly 100 has a first end (indicated by P) and a second end (indicated by Q). The mandrel is operationally supported at end P by a disconnectable supporting member 130 reversibly movable away from the mandrel assembly (as indicated by the double-headed arrow, a . . . a'). Preferably, the disconnectable supporting member 130 is movable at end P, and thereby detachable in an outward direction in manner such that end Q remains connected, in cantilever fashion via axle member 135, to a frame member of the electrostatographic machine (frame member not shown). Outward and inward directions are defined at end P as pointing respectively away from, and toward, end P.

Sleeve-supporting member 120, labeled D, is rotatable about the roller axis and preferably has a predetermined outer diameter which is substantially constant along an operational length of the sleeve-supporting member, i.e., along a length wherein pressure contact is made by the roller when in operation use with another rotatable member included in the electrostatographic machine, e.g., another roller or a web. The sleeve-supporting member 120 preferably has a flat end surface 121 facing outward. Sleeve-supporting member 120, which is preferably generally hollow, may be constructed of any suitable material, preferably aluminum, and typically includes internal structural or reinforcing elements (not shown).

An inner termination plate (ITP) 115, labeled C, is operationally secured to end surface 121 of the sleeve-supporting member 120, the ITP preferably having a flat inward surface (not separately labeled) facing inward towards the preferably flat end surface 121 of the sleeve-supporting member. The inward surface of the ITP contacts the end surface 121 of the sleeve-supporting member 120 so as to form a first interface therebetween, the ITP further having a preferably flat outward surface 116.

A middle termination plate (MTP) 110, labeled B, is connected to the inner termination plate (ITP) 115, the MTP having a plurality of radially-extending grooves formed in a preferably planar inward surface thereof (not separately labeled). The inward surface of the MTP faces inward and contacts the outward surface 116 of the ITP so as to form a second interface therebetween, the radially-extending grooves extending from an annular recess (not shown in FIG. 1) formed in the inward surface of the MTP to a perimeter of the MTP, the second interface including the inward surface of the MTP and the radially-extending grooves so as to cooperate to form a first annular chamber and a plurality of radially-extending air passageways connecting the first annular chamber and the perimeter of the MTP, the first annular chamber being connectable to a source of pressurized air, whereby a plurality of radially directed air streams are created at the perimeter of the MTP when pressurized air is introduced into the first annular chamber, the MTP further including a preferably planar outward surface 112 facing in the direction, a. The plurality of radially-extending air passageways connecting the first annular chamber and the perimeter of the MTP are ended by a corresponding plurality of terminations or openings, e.g., opening 111, from which the plurality of radially directed air streams can be directed as described. Preferably the openings such as opening 111 are equally spaced circumferentially.

An outer termination plate (OTP) 105, labeled A, is operationally connected to the middle termination plate (MTP) 110, and is reversibly removable therefrom. The OTP has a plurality of radially-extending grooves formed in a preferably planar inward surface thereof. The inward surface of the OTP (not separately labeled) contacts the outward surface 112 of the MTP so as to form a third interface therebetween, the grooves of the OTP extending radially from an annular recess of the OTP, the annular recess of the OTP formed in the inward surface of the OTP to a perimeter of the OTP, the third interface including the inward surface of the OTP and the radially-extending grooves of the OTP so as to cooperate to form a second annular chamber (not shown in FIG. 1) and a plurality of radially-extending air passageways connecting the second annular chamber and the perimeter of the OTP, the second annular chamber being connectable to a source of pressurized air, whereby a plurality of radially directed air streams are created at the perimeter of the OTP when pressurized air is introduced into the second annular chamber. The OTP further includes an outward preferably planar surface 107 located furthermost from the sleeve-supporting member and facing the outward direction, a. The plurality of radially-extending air passageways connecting the second annular chamber and the perimeter of the OTP are ended by a corresponding plurality of terminations or openings, e.g., opening 106, from which the plurality of radially directed air streams can be directed as described. Preferably the openings such as opening 106 are equally spaced circumferentially.

With further reference to FIG. 1, mandrel assembly 100 includes axle members 125 and 135 for supporting the double-sleeved roller, with axle member 125 rotatable in a bearing 140 and axle member 135 rotatable in a bearing 141, with bearing 141 anchored to a support member such as a frame member (frame member not shown). Bearing 140 is operationally supported by the disconnectable support member 130, and preferably bearing 140 and its housing (details of bearing 140 not illustrated) remain attached to axle member 125 when there is occasion to change or replace a sleeve member. Consequently, in order to replace a sleeve member, the disconnectable support member 130 is preferably detachable in the outward direction from the housing of bearing 140, with members 105, 110, 115 and 120 staying untranslated axially and supported in cantilever fashion by the axle member 135. In an alternative embodiment the axle member 125 can be formed as two axially adjacent pieces detachable one from another (not illustrated), with one piece surrounded by bearing 140 and the other piece connected to the mandrel, and such that bearing 140 is captured permanently by member 130. In general, the disconnectable support member 130 is translatable parallel to the roller axis, or alternatively, the disconnectable support member 130 can be included in or mounted on a hinged mechanism for providing the requisite motion in the outward direction (hinged mechanism not illustrated).

It is preferred that outer termination plate 105 have a central hole (central hole not shown in FIG. 1, see FIGS. 6, 7, and 9) such that in a condition with the disconnectable support member 130 disconnected and moved away as described above, plate 105 can be disconnected from the middle termination plate 110 and translated over the housing of bearing 140 and away from axle member 125. In an alternative embodiment, any suitable elements (not illustrated) can be employed so as to provide a mechanism for disconnectably supporting in cantilever fashion at least the members A, B, C and D, i.e., such that members 105, 110, 115 and 120 are not moved axially when a supporting member such as for example member 130 is moved in the outward direction.

As indicated in FIG. 1, an optional power supply (PS) 145 activated by a switch 146 can be used to apply an electrical bias to the mandrel of assembly 100, e.g., to the sleeve-supporting member 120, as illustrated. In order to be able to apply an appropriate voltage, the mandrel must be electrically isolated from the electrostatographic machine, preferably by using an insulating material. Preferably, this insulating material separates each of the axle members 125 and 135 from the mandrel and so prevents electrical contact therebetween. In an alternative embodiment, PS 145 can be connected to a conductive layer included in the outer sleeve member. In other embodiments, switch 146 and PS 145 are not required and the mandrel is connected to ground potential.

Pressurized air can be introduced (see arrow b) via an entry port 137 leading into an interior volume 136 located inside axle member 135, and from thence into a pipe 138 and ultimately to the first and second annular chambers described above.

In one embodiment, pipe 138 passes into a hollow interior portion of sleeve-supporting member 120 and there divides into two pipes (not illustrated). One of these two pipes is selectively connectable with the first annular chamber formed between members A and B, and the other pipe is selectively connectable with the second annular chamber formed between members B and C. A switch mechanism (e.g., an electrically activated switch mechanism) directs the pressurized air into one or the other of the two pipes for purpose of removing and/or replacing a corresponding sleeve member.

In a preferred embodiment, such as is described below, a pipe such as pipe 138 leads directly through a hollow interior portion of sleeve-supporting member 120 to the second annular chamber (defined by members A and B) and from thence to the plurality of openings exemplified by opening 106 so as to provide the above-described plurality of radially directed air streams for removal and/or replacement of an outer sleeve member. In such a preferred embodiment, the first annular chamber (defined by members B and C) is prevented from connecting with pipe 138 by a removable mechanical obstruction or a plug (not illustrated in FIG. 1). In order to replace an inner sleeve member in this preferred embodiment, the following sequential steps are employed: support member 130 is disconnected and moved away, the source of pressurized air is turned on so as to expand the outer sleeve member, the outer sleeve member is removed, the source of pressurized air is disconnected from entry port 137, the outer termination plate A is removed, the mechanical obstruction or plug is removed, connection is made between pipe 138 and the first annular chamber, and the source of pressurized air is turned on so as to expand the inner sleeve member so that the inner sleeve member can be removed or replaced. The Cormier, et al. U.S. patent application Ser. No. 10/965,412 filed with the U.S. Patent and Trademark Office on even date herewith, discloses a device for making connection between a pipe, such as pipe 138, and the first annular chamber, which device additionally aids removal and replacement of an inner sleeve member.

In an alternative embodiment (not illustrated) a first entry port for pressurized air connects to a first pipe leading to a first annular chamber such as described in relation to FIG. 1, and a second entry port for pressurized air connects to a second pipe, which second pipe leads to a second annular chamber as described above. However, such an alternative embodiment may be more costly and relatively difficult to manufacture.

FIG. 2 shows a portion 150 of a preferred embodiment of a double-sleeved roller of the invention, with the portion 150 including members A, B, C, and D of the mandrel of FIG. 1, as well as edge portions of both the inner and outer sleeve members operationally mounted on the mandrel. Inner sleeve member (ISM) 152 is in operational non-adhesive gripping contact around outer surface 155 of sleeve-supporting member 120, with outer sleeve member (OSM) 151 covering the ISM and in operational non-adhesive gripping contact around the ISM in mutual contact therewith.

Figure 4A:
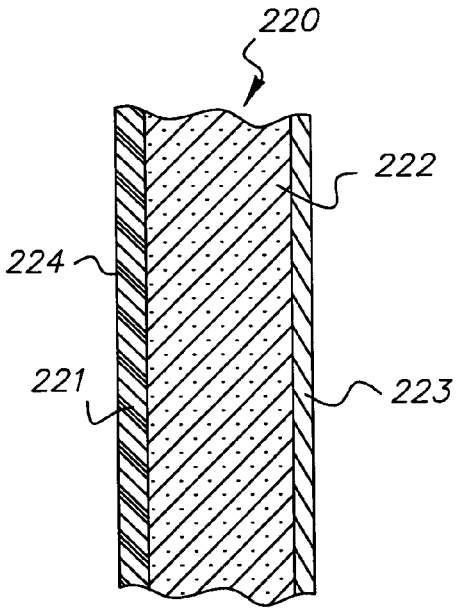
(PRIOR ART) FIG. 4A
FIG. 4A schematically illustrates an inner sleeve member of prior art in cross-sectional view.
Figure 4B:
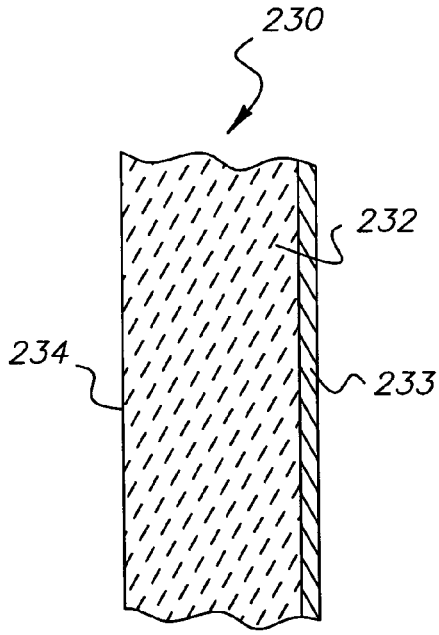
FIG. 4B schematically illustrates in cross-sectional view a preferred inner sleeve member for use in the invention.

FIG. 4B shows a cross-section 230 of a preferred compliant inner sleeve member (ISM). For comparison, FIG. 4A shows a cross-section 220 of a prior art compliant ISM. A preferred ISM includes a relatively thick compliant layer 232 and a relatively thin hard flexible protective overcoat layer 233. The ISM preferred for the invention is preferably an unreinforced tubular sleeve, i.e., preferably having no backing layer, with inner surface 234 of the compliant 232 layer in intimate operational contact with the mandrel (as shown in FIG. 2). A preferred ISM inclusive of layers 232 and 233 preferably has a thickness in a range of approximately between 0.2 mm and 14 mm, and more preferably, has a thickness of 0.500 mm±0.005 mm. On the other hand, the prior art ISM of FIG. 4A includes a relatively thick compliant layer 222, a relatively thin hard flexible protective overcoat layer 223, and a high modulus backing layer or strengthening layer 221 having an inner surface 224 operationally contacting the mandrel. Inclusion of the backing layer 221 makes the prior art ISM of FIG. 4A disadvantageously more complicated and hence more expensive to fabricate than the preferred ISM of FIG. 4B. Much more importantly, the backing layer makes a typical prior art ISM almost inextensible, and thus generally unable to readily conform to the outer shape of the middle termination plate 110 as illustrated by ISM 152 of FIG. 2. Such conformation of the ISM requires a certain interference (see below) and is a key requirement for a double-sleeved roller of the invention.

Returning to FIG. 2, inner sleeve member 152 is preferably similar to the non-reinforced ISM 230 illustrated in FIG. 4B. ISM 152 is stretchably deformable and preferably grips surface 155 of sleeve-supporting member 120 with an interference of approximately 10 mm±5 mm. It is noteworthy that such a large interference of ISM 152 ensures critical conformance of ISM 152 with the outer shape of the middle termination plate B. (An interference of a sleeve member is defined herein as an increase of inner diameter of the unstretched sleeve member after stretchably mounting the sleeve member so as to grip an underlying member, the underlying member having an outer diameter larger than the inner diameter of the unstretched sleeve member).

Outer sleeve member (OSM) 151 is preferably a reinforced tubular sleeve. Preferably, the OSM grips ISM 152 (where in mutual contact) with an interference of less than approximately 125 micrometers, and more preferably approximately 75±25 micrometers. Typically OSM 151 has a multilayer structure (not illustrated) which multilayer structure preferably includes a high modulus backing layer with one or more layers coated on the backing layer. For example, the high modulus backing layer can be made of nickel and the multilayer structure of OSM 151 can for example include a conventional composite photoconductor structure having a charge generation layer and an overlying charge transport layer.

As shown in FIG. 2, inner sleeve member (ISM) 152 not only grips sleeve-supporting member 120, but also grips a cylindrically-shaped portion 156 of the inner termination plate, C, as well as a cylindrically-shaped portion 157 of the middle termination plate, B. Outer sleeve member (OSM) 151 grips ISM 152 along the operational length of sleeve-supporting member D as well as where ISM 152 contacts cylindrically-shaped portions 156 and 157. OSM 151 further grips a cylindrically-shaped portion 158 of the outer termination plate, A, such that OSM 151 covers at least a part of, and preferably substantially all of, cylindrically-shaped portion 158. Inner termination plate 115 includes a portion with a tapered outer shape having a sloping surface 159. Similarly the middle termination plate 110 and outer termination plate 105 have portions with tapered outer shapes having respective sloping surfaces 160 and 161. Sloping surfaces 159, 160, and 161 can have any useful shape such that the outside diameter of the tapered outer shape decreases steadily in the direction parallel to the axial direction, a, of FIG. 1. Preferably, each of the slopes of the sloping surfaces 159, 160, and 161 is a constant, so that the tapered outer shapes preferably have the form of conical tapers. More generally, for each of the members A, B, and C, the tapered outer shape is defined by a maximum diameter and a minimum diameter, the maximum diameter being substantially equal to the outer diameter of the cylindrically-shaped portion of the respective member. The minimum diameter of member C is defined by a perimeter of the preferably flat outward surface 116 of member C which is in contact with member B, and the minimum diameter of member B is defined by a perimeter of the preferably flat outward surface 112 of member B which is in contact with member A.

Inner sleeve member 152 overlaps and snugly grips a length, c', on the sloping surface 160 of the tapered outer shape of member B, with ISM 152 having a terminating edge 162. The edge 162 is located such that a part of sloping surface 160 which is not covered by the overlapping portion of ISM 152 has a length, c, measured along surface 160. The length, c, is preferably in a range of approximately between 0.5–3 mm, and more preferably approximately 1 mm. The length, c', which overlaps sloping surface 160 and is measured thereon as shown, preferably has magnitude such that (c+c') is greater than about 9 mm.

The non-overlapped length, c, is a critical dimension. It may be seen that an enclosure labeled W is formed by the undersurface 154 of OSM 151, by the overlapping portion of ISM 152 having the length c', by the uncovered length c, and by the inward surface 112 of member A. For reliable removal or replacement of the outer sleeve member 151, it is required that the uncovered length c, be sufficient so as to leave airflows unimpeded from the openings located at the ends of the plurality of radially-extending air passageways connecting the second annular chamber and the perimeter of the outer termination plate (such as opening 106 of FIG. 1). The enclosure W provides a suitable volume for pressurized air to apply an expansion force to that portion of the undersurface 154 of OSM 151 overlying the tapered surface 160 of member B.

Similarly, an enclosure labeled V is formed by the undersurface 153 of ISM 152, the sloping surface 159, and by the inward surface of member B. On an occasion when ISM 152 is to be removed, the enclosure V provides a suitable volume for pressurized air to apply an expansion force to that portion of the undersurface 153 of ISM 152 overlying the sloping surface 159.

As shown in FIG. 2, the cylindrically-shaped portion 158 of member A preferably has an outer diameter larger by a certain known amount than the cylindrically-shaped portions 157 and 156 of members B and C, respectively. It is also preferred that the outer diameters of the cylindrically-shaped portions 157 and 156 are substantially equal to one another, although they may be different from one another. Preferably, the cylindrical outer shape of portion 158 has an outer diameter larger than the outer diameter of the cylindrical outer shapes of portions 156 and 157 by an amount 2S, where S is indicated in FIG. 2. It is preferred that the following relation holds:

$$2S=2U+\Delta$$

The quantity U represents a certain thickness of the inner sleeve member 152, and the symbol Δ represents a dimension preferred to be in a range of approximately between 10 micrometers –30 micrometers.

Notwithstanding the above-described preference for a non-reinforced ISM in a double-sleeved roller using the above-described novel mandrel, an alternative embodiment provides an ISM (for use with a similar mandrel) which includes a high modulus backing layer, or a reinforcing layer. In this alternative embodiment, the backing layer is covered by a compliant layer, with the compliant layer entirely coating the backing layer and extending beyond at least one of the edges of the backing layer so as to provide at least one width of compliant material which contacts the mandrel where there is no backing layer. Such a width of unbacked compliant material can for example grip a cylindrically-shaped portion such as portion 157 of member B of FIG. 2 and also grip a tapered portion such as sloping surface 160 in manner similar to that of ISM 152, whilst that portion inclusive of the backing layer grippingly surrounds a sleeve-supporting member such as member 120. However, such an alternative sleeve member is more difficult and more costly to manufacture than a preferred ISM such as that of FIG. 4B.

Figure 3:
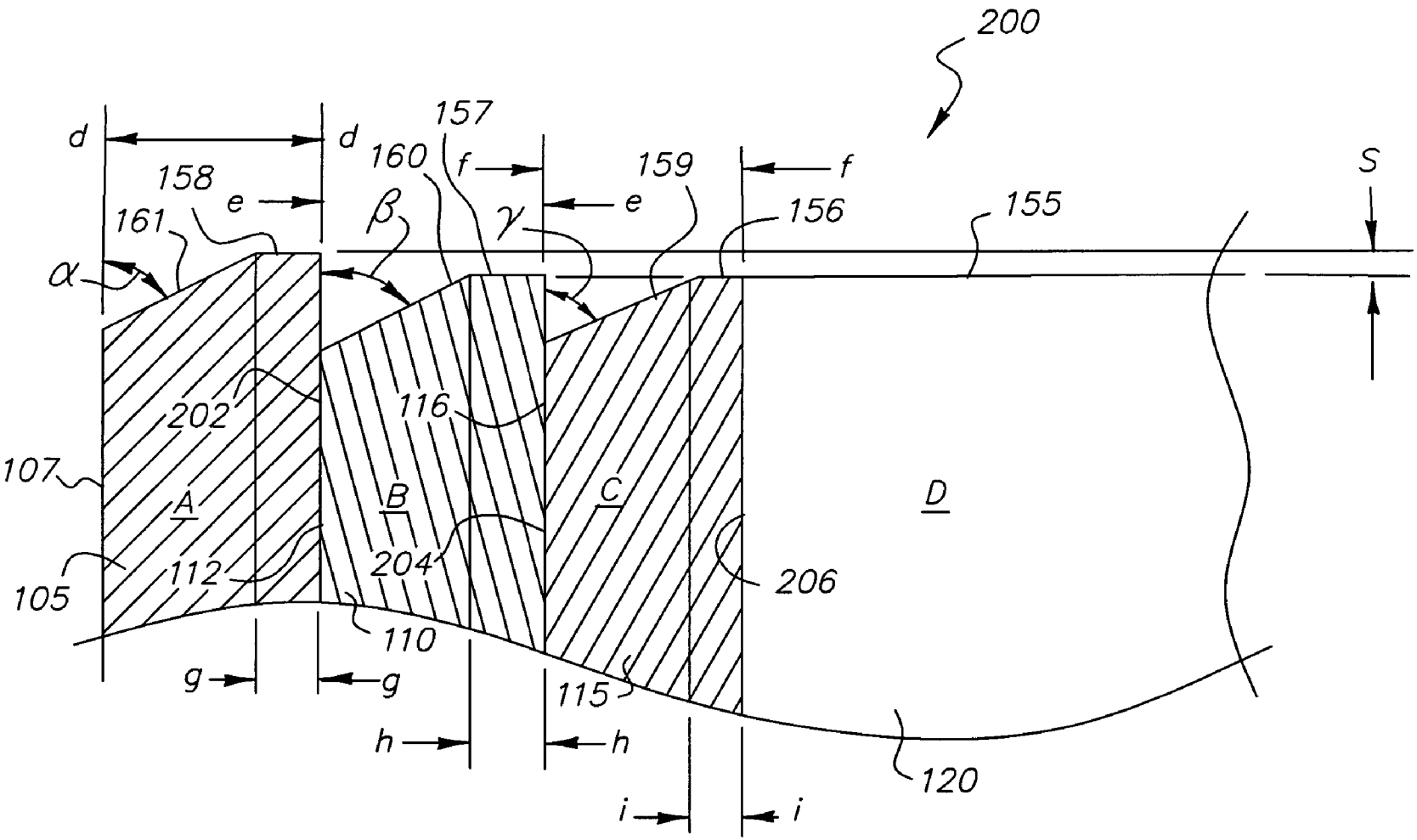
FIG. 3 illustrates dimensions of certain elements shown in FIG. 2.

FIG. 3 illustrates a portion, indicated by the numeral 200, of the mandrel assembly of FIGS. 1 and 2. FIG. 3 shows certain dimensions relating to the members A, B, C, and D of a preferred embodiment, wherein each of the members A, B, and C has an axial profile which includes a cylindrical portion and a preferably conical tapered portion such that each tapered portion is defined by a respective taper angle.

For mandrel assembly portion 200 of FIG. 3, the portion 156 of inner termination plate (ITP) 115 having a cylindrical outer shape has an axial length (indicated by the arrows, i) which is typically less than about 2 mm. The sloping adjoining portion of ITP 115 has an outer shape 159 preferably in the form of a conical taper having a taper angle, γ, which taper angle is preferably in a range of approximately between 5°–45°, and more preferably between 10°–20°. A maximum axial thickness of ITP 115 as measured between preferably flat inner face 206 and preferably flat outer face 116 (indicated by the arrows, f), is typically about 7±3 mm.

The portion 157 of middle termination plate (MTP) 110 having a cylindrical outer shape has an axial length preferably in a range of approximately between 2 mm–6 mm (indicated by the arrows, h). The sloping adjoining portion of MTP 110 preferably has an outer shape 160 in the form of a conical taper having a taper angle, β, which taper angle is preferably in a range of approximately between 5°–45°, and more preferably between 10°–20°. A maximum axial thickness of MTP 110 as measured between preferably flat inner face 204 and preferably flat outer face 112 (indicated by the arrows, e) is preferably in a range of approximately between 12 mm–16 mm.

The portion 158 of outer termination plate (OTP) 105, having a cylindrical outer shape, has an axial length which is a critical dimension. In general, if this length is too short, pressurized air can disadvantageously leak out when attempting to remove an outer sleeve member. Conversely, if this length is too long, it is difficult to mount an outer sleeve member because of too great a sliding resistance. Thus, whatever the composition of the outer sleeve member for use in the present invention, it is necessary that the axial length of portion 158 have a suitable length so as to satisfy these criteria. In a preferred roller employing an outer sleeve member such as described above (i.e., having a backing layer) the axial length of portion 158 of outer termination plate (OTP) 105 is preferably in a range of approximately between 3.5 mm–6.0 mm (indicated by the arrows, g) and more preferably, approximately between 4.0 mm–5.0 mm. The sloping adjoining portion of OTP 105 preferably has an outer shape 161 in the form of a conical taper having a taper angle, $\alpha$, which taper angle is preferably in a range of approximately between 1.5°–15°. More preferably, $\alpha$ is 5°±2°. A maximum axial thickness of OTP 105 as measured between preferably flat inner face 202 and preferably flat outer face 107 (indicated by the arrows, d) and is typically in a range of approximately between 12 mm–16 mm. As described above with reference to FIG. 2, the respective outer diameters of the cylindrical portions 157 and 156 of ITP 115 and MTP 110 are preferably substantially equal, the inner sleeve member 152 has a certain thickness, U, and the outer diameter of the cylindrical outer shape 158 of the OTP 105 exceeds the outer diameters of the cylindrical portions 157 and 156 by a known amount 2S. The dimension $\Delta$ is critical and preferably has a magnitude of approximately 20 micrometers±10 micrometers, where $\Delta=2(S-U)$ as defined above. Thus the outer radius of the cylindrical portion 158 of the OTP 105 is preferably larger than the outer radius of the operationally mounted outer sleeve member 151 by an amount $(S-U)=(\Delta/2)$.

Preferably, the concentricities of the members A, B, C, and D are accurately similar to one another. It is preferred that the individual concentricities differ from a certain mean concentricity by less than about 40 micrometers. Ideally, the outer shapes of the cylindrical portions of the members A, B, C, and D, viewed axially, have cylindricities which are preferably substantially equal to one another. Furthermore, members B, C, and D are mated to one another in a preferred manner such that the corresponding outer shapes are substantially similar, i.e., members B, C, and D have surfaces which are preferably mutually smooth within 5 micrometers longitudinally, i.e., in direction parallel to the roller axis. Such mutual smoothness and similarity of outer shapes is preferably achieved by connecting members B, C, and D in manner used operationally and then co-grinding these three members to a desired common outer diameter and smoothness.

Figure 5:
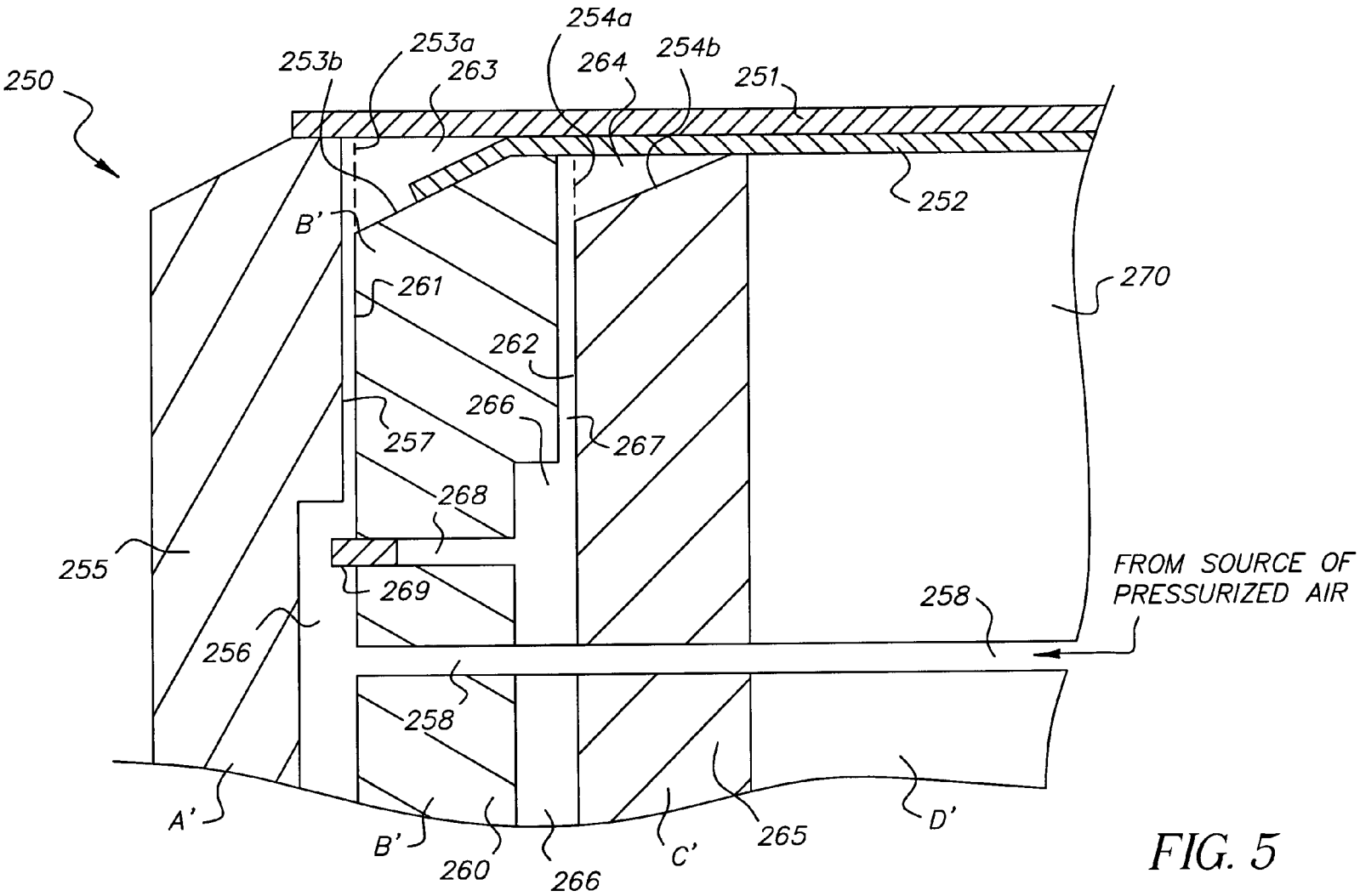
FIG. 5 shows, in schematic cross-section, a side view of a portion of a roller of the invention inclusive of four axially joined members, three of which members define two sets of radial channels for the conveyance of pressurized air to the undersides of the inner and outer sleeve members respectively.

FIG. 5 shows, in schematic cross-section, a side view of a generalized portion 250 of a roller of the invention, portion 250 being inclusive of four axially joined members, A', B', C' and D' (identified respectively by the numerals 255, 260, 265, and 270 and corresponding respectively to members A, B, C, and D of FIGS. 1, 2, 3). Members A', B', and C' define two sets of radial channels for the conveyance of pressurized air to the undersides of an inner sleeve member (ISM) 252 and an outer sleeve member (OSM) 251. A pipe 258, connectable to a source of pressurized air, is provided for carrying pressurized air through the interior of sleeve-supporting member 270 into an interior chamber 256 of roller portion 250 (with pipe 258 corresponding to pipe 138 of FIG. 1). Interior chamber 256, created by cooperation of members A' and B', has a plurality of radial channels or connections, e.g., connection 257, leading to an enclosed annular volume 263. The volume 263 is defined by the underside of OSM 251, by the covered and uncovered portions of sloping surface **253*b* of the middle termination plate (MTP) 260, and by a preferably flat inward facing surface 253*a* of outer termination plate (OTP) 255 (indicated by a dotted line). A feature of the invention is that each of the plurality of connections or radial channels such as connection 257 is created from a groove formed in surface 253*a*. Each such groove is enclosed by a preferably flat outward surface 261 of MTP 260 so as to form a radial channel. Preferably, there are at least eight equivalent radial channels leading from interior chamber 256 to annular volume 263. Surfaces 253*a* and 261 are mating surfaces pressed against one another via a suitable mechanism for joining OTP 255 to MTP 260, e.g., via bolts or screws (not illustrated in FIG. 5). Similarly, an interior chamber 266, created by cooperation of members B' and C', has a plurality of preferably at least eight equivalent connections, e.g., connection 267, leading to an enclosed annular volume 264. The volume 264 is defined by the underside of ISM 252, by the sloping surface 254*b* of the inner termination plate (ITP) 265, and by a preferably flat inward facing surface 254*a* of MTP 260 (indicated by a dotted line). A feature of the invention is that each of the plurality of connections or radial channels such as connection 267 is created from a groove formed in surface 254*a*. Each such groove is enclosed by a preferably flat outward surface 262 of ITP 265 so as to form a radial channel. Surfaces 254*a* and 262 are mating surfaces pressed against one another via a suitable mechanism for joining MTP 260 to ITP 265, e.g., via bolts or screws (not illustrated in FIG. 5). A pipe 268 connects interior volumes 256 and 266, with pipe blocked as shown by any suitable device 269. Device 269 can for example be a gating device, a flap, a valve, a cap, a plug, and so forth. Preferably device 269** is a removable member, such as a screw or a removable plug, e.g., a plug made of a deformable material such as rubber.

With device 269 blocking tube 268 as shown, an admission of pressurized air into chamber 256 and from thence into annular volume 263 will expand outer sleeve member 251, thus permitting removal of OSM 251 from the roller portion 250 by sliding OSM 251 over the outer termination plate, A'. With further admission of pressurized air, a new outer sleeve member may be slidably installed in the reverse direction over the outer termination plate A' and then over the existing inner sleeve member 252.

On the other hand, it may be required to remove and/or replace ISM 252 (with OSM 251 removed). This can be accomplished by the steps of: (1) removing outer termination plate A'; (2) opening pipe 268, e.g., by removing a plug 269; (3) making connection, on the outer side of member B', between pipes 258 and 268; (4) admitting pressurized air into pipe 258 and from thence into pipe 268 and the radial channels such as channel 267 linking interior volume 266 and annular volume 264, thereby expanding inner sleeve member 252; and (5) slidably moving ISM 252 off the mandrel. To mount a new inner sleeve member on the mandrel, the above steps are carried out in reverse order. Alternatively, in lieu of step (3), a source of pressurized air can be directly connected to pipe 268 for purpose of expanding inner sleeve member 252.

For step (3) above, the pipes 258 and 268 can be connected using any suitable connecting device, e.g., a U-shaped tubular member or a hose (connecting mechanism not illustrated). For carrying out step (3) it has been found advantageous to attach, in lieu of member A', a specially-shaped member to the outer face 261 of member B'. The specially-shaped member has a novel axial profile (specially-shaped member not illustrated). The specially-shaped member also provides for interior connection between pipes 258 and 268, such that the specially-shaped member and the member B'jointly and cooperatively form this interior connection. The specially-shaped member is disclosed in the Cormier, et al. co-pending patent application Ser. No. 10/965,412 filed with the U.S. patent and Trademark Office on even date herewith.

Figure 8:
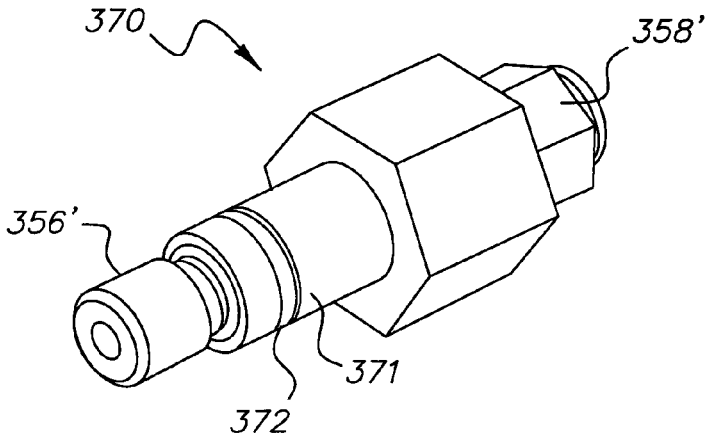
FIG. 8 illustrates an assembly for supplying pressurized air to the mandrel of the preferred embodiment of the roller of FIG. 6.
Figure 6:
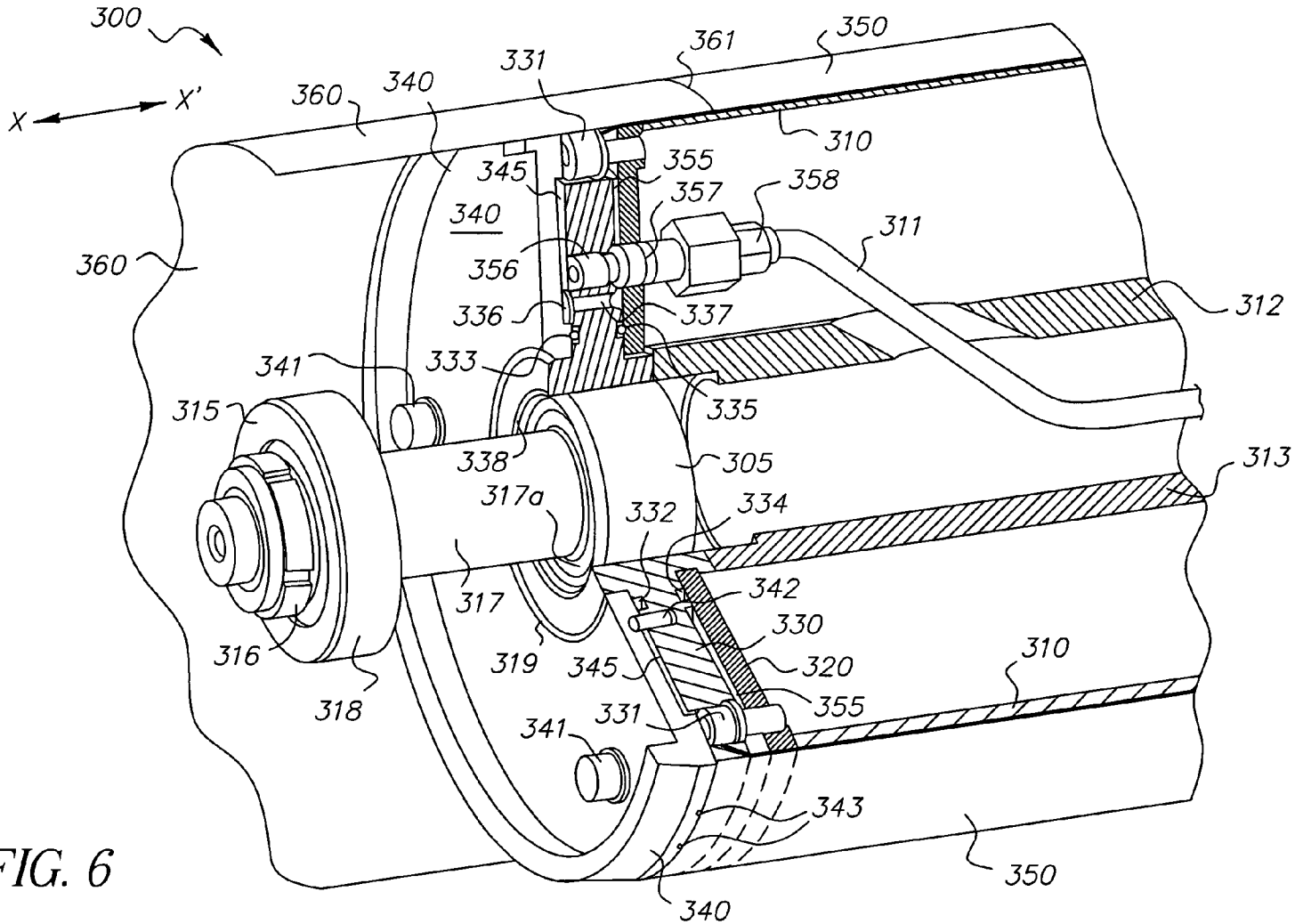
FIG. 6 illustrates a cutaway view of a portion of a preferred embodiment of a roller of the invention including a securely mounted inner sleeve member and a partially-mounted outer sleeve member.
Figure 7:
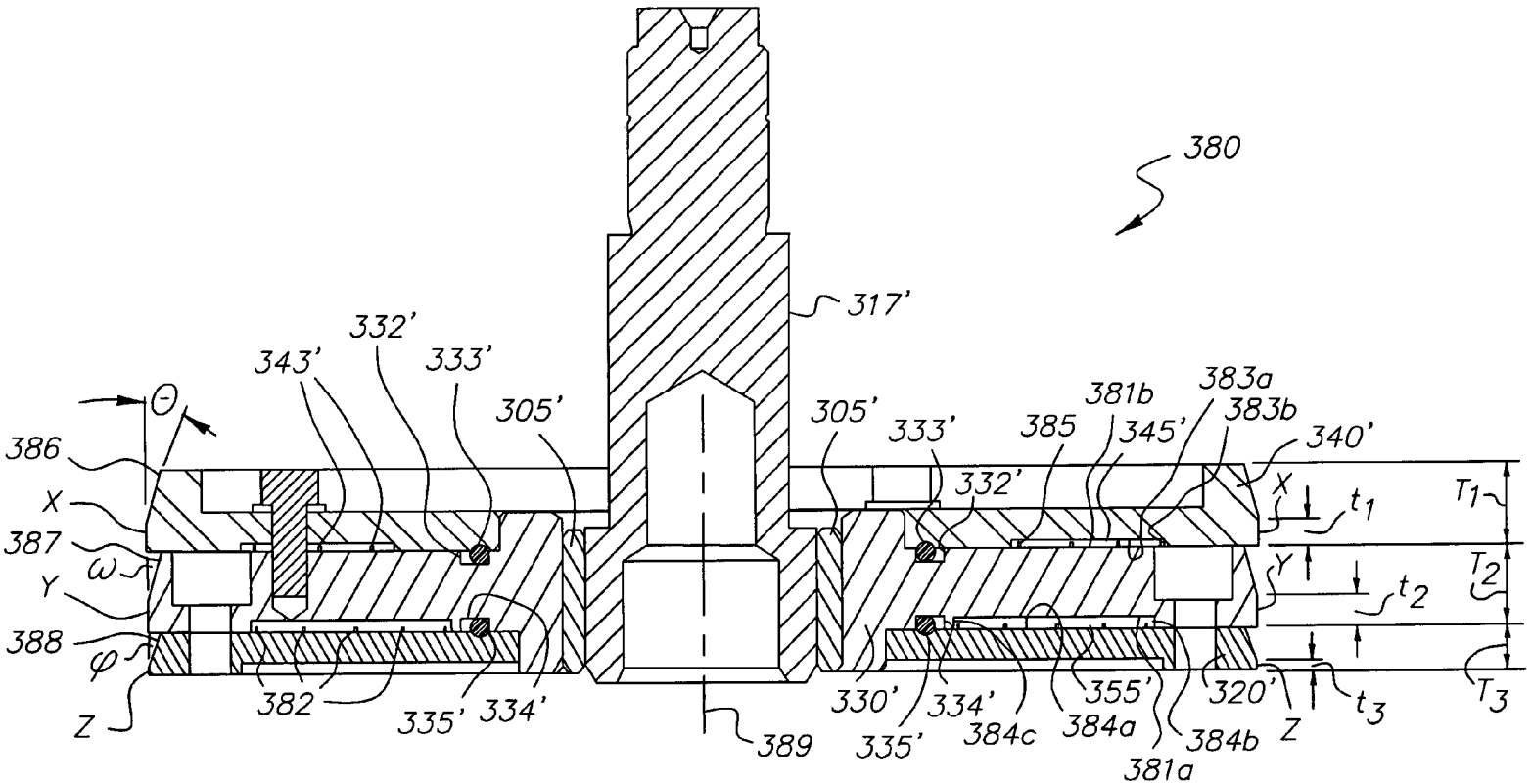
FIG. 7 shows a cross-section of a portion of the mandrel of the preferred embodiment of the roller of FIG. 6, with critical dimensions indicated.
Figure 9:
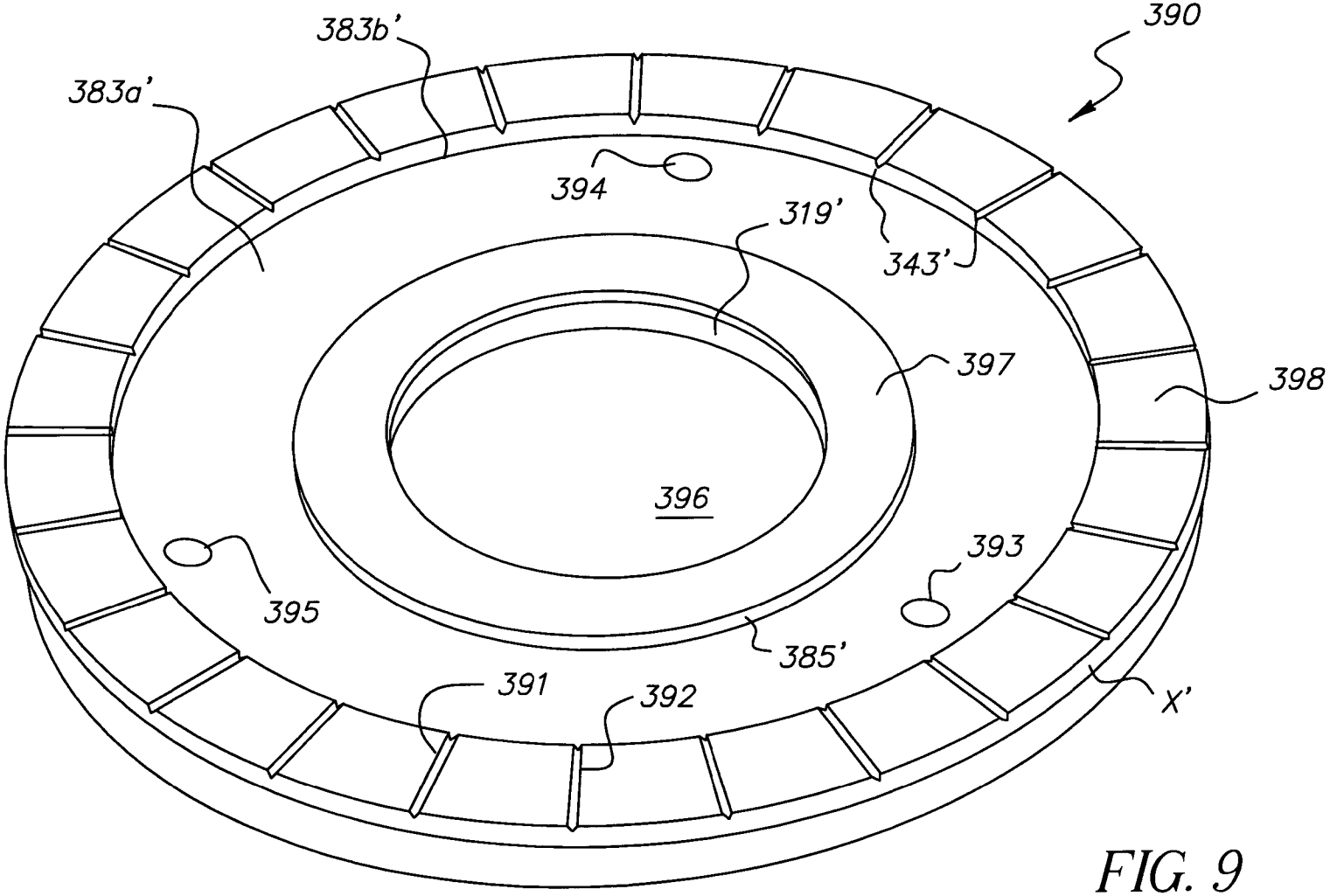
FIG. 9 shows a view in perspective of an outer termination plate included in the portion of the mandrel of FIG. 7.

FIG. 6 illustrates a portion of a particular preferred embodiment 300 of a double-sleeved roller according to the invention, and FIGS. 7, 8, and 9 describe individual elements thereof. In FIGS. 7 and 8, the particular entities identified by numerals bearing a prime (') are similar in all respects to corresponding entities bearing unprimed numerals in FIG. 6.

Turning now to FIG. 6, roller portion 300 is shown as a cutaway 3-dimensional view which includes portions of a securely mounted inner sleeve member (ISM) 350 and a partially-mounted outer sleeve member (OSM) 360 having an inward edge 361, with a section of the OSM 360 not shown so as to reveal the underlying ISM 350 as well as certain elements of the mandrel assembly. A sleeve-supporting member 310, preferably made of aluminum, is gripped by ISM 350. Sleeve-supporting member 310 includes internal longitudinal reinforcing members, e.g., members 312, 313, also preferably made of aluminum. Inner termination plate (ITP) 320, preferably made of aluminum, is detachably attached to member 310, preferably via bolts or screws (not visible in FIG. 6). Middle termination plate (MTP) 330, preferably made of aluminum, is detachably attached to ITP 320 preferably via bolts 331. Outer termination plate (OTP) 340, preferably made of stainless steel, is detachably attached to MTP 330 preferably via bolts 341, which bolts preferably have threaded ends screwed into MTP 330.

MTP 330 is formed having an annular recess such that with MTP 330 attached to ITP 320 as shown, the ITP 320 and the MTP 330 cooperate so as to form a first annular chamber 355 (see also FIG. 7). In addition, the ITP 320 and the MTP 330 cooperate so as to form a plurality of radially-extending air passageways (not visible in FIG. 6) connecting chamber 355 and the perimeter of MTP 330, as previously described above (the endings of these air passageways are covered by inner sleeve member 350).

OTP 340 is formed having an annular recess such that with OTP 340 attached to MTP 330 as shown, the OTP 340 and the MTP 330 cooperate so as to form a second annular chamber 345. In addition, the OTP 340 and the MTP 330 cooperate so as to form a plurality of radially-extending air passageways connecting chamber 345 and the perimeter of OTP 340, the passageways terminating at endings such as endings 343 (see also FIGS. 7 and 9).

A pipe 311 is provided for transporting pressurized air into chamber 345 for removing or replacing the partially-mounted outer sleeve member 360 (indicated by the double ended arrow, x . . . x'). Pipe 311 is connectable to a source for the pressurized air, with pipe 311 housed in a hollow portion of member 310. Pipe 311 is connected to an assembly for supplying the pressurized air to chamber 345 via a pneumatic connector 358 and a nozzle 356, the assembly including a portion passing through a hole in the inner termination plate 320 and sealed, preferably using an o-ring 357, so as to prevent leakage of pressurized air from chamber 345 (also see FIG. 8). A bore 337 connects chambers 345 and 355. A removable preferably deformable plug member 336, made for example of rubber, is seated on the inward face of the outer termination plate 340 and urged by the OTP 340 against the outward end of the bore 337 so as to seal the bore 337 and thus prevent pressurized air from passing from chamber 345 into chamber 355. The plug member 336 preferably has a flat surface in contact with OTP 340 and a rounded surface such as a spherical section pressed against bore 337. Annular grooves 332 and 334, for respectively housing o-ring seals 333 and 335, are formed in the outer and inner faces of the middle termination plate 330.

Roller portion 300 is provided with a shaft member 317 which is rotatable inside a roller bearing 315, the bearing member being secured on shaft member 317 by a nut 316. It is preferred for shaft member 317 to be made of a rigid material, preferably stainless steel. For demounting or mounting of the outer sleeve member 360 (in directions x, x') the illustrated end of roller portion 300 is disconnected (as is shown in FIG. 6) from a disconnectable supporting member for operationally supporting shaft member 317 (disconnectable supporting member not illustrated). The other end of the roller (not illustrated) is supported in cantilever fashion and is thereby connected to a frame member of the electrostatographic machine. For usage of the fully assembled roller, the disconnectable supporting member for holding shaft member 317 is moved into operational position and connected to the roller by attaching the disconnectable supporting member so as to securely grip the exterior cylindrical surface 318 of the housing of the roller bearing 315.

Outer termination plate (OTP) 340 is provided with an axially centered round hole defined by circular wall 319, which round hole has a diameter larger than the outer diameter of the cylindrical surface 318. Thus with outer sleeve member 360 completely demounted (slid off the roller in the direction, x) and the bolts 341 removed, the (OTP) 340 is readily removable by translating it in the direction, x, and thereby passing it over the housing of the roller bearing 315. Removal of OTP 340, e.g., for purpose of replacing the inner sleeve member 350 as described herein above, also permits removal of the plug 336 for the same purpose. After a new inner sleeve member has been installed, plug 336 may be replaced (or a new plug installed in lieu of the original). During subsequent reassembly of OTP 340 on to the mandrel, a guide pin 342 is used to accurately guide repositioning of OTP 340 and to assist in reinstallation of the bolts 341.

In the preferred embodiment of FIG. 6, a ring-shaped insulator member 305 provides electrical insulation of the mandrel from the shaft member 319. A similar ring-shaped insulator member (not shown) surrounds a shaft member located at the other end of the roller (not illustrated in FIG. 6). Thus the mandrel can be electrically isolated from the electrostatographic machine, and thereby is electrically biasable to any suitable voltage by a power supply, as indicated in FIG. 1. It is preferred that both of these ring-shaped insulator members be made from a ceramic material, preferably alumina. Ring-shaped insulator member 305 directly contacts and tightly grips an element 317*a* which it surrounds. Element 317*a* is preferably a metallic ring which is securely mounted on shaft member 317, or alternatively, element 317*a* can be an annularly raised portion of shaft member 317. A tight fit can for example be obtained by cooling the element 317*a*, sliding the insulator member 305 around element 317*a*, and then allowing the assembly to warm to ambient temperature. The middle termination plate 330 is provided with a central hole 338. The outer surface of the ring-shaped insulator member 305 has a tight fit in hole 338, which tight fit can for example be obtained by a heating of the middle termination plate 330, moving the heated MTP 330 into position on the ring-shaped insulator member 305, and then allowing the assembly to cool to ambient temperature. Thus a permanently connected structure is formed which embodies the MTP 330, the insulator member 305, and the element 317*a* which is surroundingly gripped by the insulator member.

FIG. 7 shows, with certain critical dimensions indicated, a cross-section 380 of a portion of the mandrel of the preferred embodiment of FIG. 6, which portion includes the inner termination plate 320', middle termination plate 330', outer termination plate 340', shaft member 317', and insulator member 305'. The circumferential surfaces of the three termination plates are cylindrically symmetric around the mandrel (roller) axis 389. Cross-section 380 includes the annular chambers 345' and 355'. Annular chamber 345' is formed from outwardly facing flat surface 381*b* of MTP 330', and from the walls 383*b*, 385, and inwardly facing flat surface 383*a* which define an annular recess in OTP 340' (see FIG. 9), with annular chamber 345' connecting to the starting points 343' of radial channels leading to the perimeter of the surface, X. Similarly, annular chamber 355' is formed from outwardly facing flat surface 384*a* of ITP 320', and from the walls 384*b*, 384*c*, and inwardly facing flat surface 381*a* which define an annular recess in the MTP 330', with annular chamber 355' connecting to the starting points 382 of radial channels leading to the perimeter of the surface, Y.

Outer termination plate 340' has a thickness, $T_1$, which thickness includes a cylindrical portion labeled X having an axial length, $t_1$. The thickness $T_1$ further includes a conical tapered portion 386 defined by a taper angle, θ.

Middle termination plate 330' has a thickness, $T_2$, which thickness includes a cylindrical portion labeled Y having an axial length, $t_2$. The thickness $T_2$ further includes a conical tapered portion 387 defined by a taper angle, ω.

Inner termination plate 320' has a thickness, $Y_3$, which thickness includes a cylindrical portion labeled Z having an axial length, $t_3$. The thickness $T_3$ further includes a conical tapered portion 388 defined by a taper angle, ϕ.

It is preferred that the outer diameter of the cylindrical portion X is greater than that of the cylindrical portions Y and Z by an amount equal to: twice the thickness of the inner sleeve member, plus 20 micrometers±10 micrometers.

In a particular embodiment, for use with a non-reinforced inner sleeve member having a thickness of 0.500 mm, it is preferred that:

diameter of cylindrical portion X=181.62 mm diameter of cylindrical portion Y=180.60 mm diameter of cylindrical portion Z=180.60 mm $T_1$=14.0 mm;

$T_2$=14.0 mm;

$T_{3=7}$ mm;

$t_1$=4.5 mm;

$t_2$=3.8 mm;

$t_3$=1.0 mm;

θ=5 degrees±1 degree;

ω=15 degrees±5 degrees; and

ϕ=15 degrees±5 degrees.

FIG. 8 shows pressurized air supply fitting 370, inclusive of pneumatic connector 358', nozzle 356', and a cylindrical tube portion 371 having a groove 372 to house o-ring 357 (see FIG. 6).

FIG. 9 shows a view 390 of the inward facing side of outer termination plate 340' included in the portion of the mandrel 380 of FIG. 7. In FIG. 9, the particular entities identified by numerals bearing a prime (') are similar in all respects to corresponding entities bearing unprimed numerals in FIGS. 6 and 7. Preferably twenty-four equally spaced radial grooves such as grooves 391, 392 are formed (15° apart) in the flat surface 398 which is coplanar with surface 397, each groove preferably about 1 mm wide and about 1 mm deep. Groove starting points 343' lead radially outwards from an annular recess defined by flat surface 383*a'* and by the walls 383*b'*, 385', with the grooves terminating at the cylindrical surface, X'. Axially centered round hole 396 is defined by the circular wall 319'. Through-holes (preferably unthreaded) 393, 394, 395 are for bolting outer termination plate 340' to the middle termination plate 330' (by bolts 341 of FIG. 6).

In similar fashion, the inward facing side of the middle termination plate 330', which is inclusive of the annular recess defined in FIG. 7 by the flat surface 381*a* and by the walls 384*b*, 384*c*, preferably has twenty-four equally spaced radial grooves leading radially outwards from this annular recess (not separately illustrated).

The invention has been described in detail with particular reference to certain preferred embodiments thereof, but it will be understood that variations and modifications can be effected within the spirit and scope of the invention.

What is claimed:

1. A roller for use in an electrostatographic machine, said roller comprising:

(a) a sleeve-supporting mandrel, having a predetermined diameter substantially constant along an operational length thereof, said sleeve-supporting mandrel supporting a replaceable removable inner sleeve member (ISM) and outer sleeve member (OSM), said OSM covering said ISM, said ISM in non-adhesive gripping contact around said sleeve-supporting mandrel and said OSM in non-adhesive gripping contact around said ISM, said sleeve-supporting mandrel having a first end surface;

(b) an inner termination plate (ITP) operationally secured to said sleeve-supporting mandrel, said ITP having a first surface facing said first end surface of said sleeve-supporting mandrel to form a first interface therebetween, said ITP further having a second surface facing in a substantially opposite direction from said first ITP surface;

(c) a middle termination plate (MTP) having a first surface connected to said second surface of said ITP forming an interface between said ITP and said MTP, and defining an annular chamber and a plurality of radially-extending grooves, said radially-extending grooves extending from said annular chamber to a perimeter of said MTP, said annular chamber being connectable to a source of pressurized air, whereby a plurality of radially directed air streams are created at said perimeter of said MTP through said plurality of radially-extending grooves when pressurized air is introduced into said annular chamber, said MTP further including a second surface facing in a substantially opposite direction from said MTP first surface; and (d) an outer termination plate (OTP) having a first surface operationally connected to said second surface of said MTP forming a third interface between said MTP and said OTP, and defining a second annular chamber and a plurality of radially-extending grooves, said radially-extending grooves extending from said second annular chamber to a perimeter of said OTP, said second annular chamber being connectable to a source of pressurized air, whereby a plurality of radially directed air streams are created at said perimeter of said OTP through said plurality of radially-extending grooves when pressurized air is introduced into said second annular chamber, said OTP further including a second surface located facing in a substantially opposite direction from said OTP first surface.

2. The roller according to claim 1, wherein said MTP has an axial profile that comprises a portion having a cylindrical shape of a predetermined length in the axial direction, and an extension in said axial direction away from said second surface of said ITP, said extension formed with a tapered shape, said portion of said MTP having a cylindrical shape having a diameter substantially the same as said predetermined diameter of said sleeve-supporting mandrel, and said portion of said MTP having a tapered shape defined by a maximum diameter and a minimum diameter, said maximum diameter substantially equal to said diameter of said cylindrical shape of said ITP, and said minimum diameter defining a perimeter of said second surface of said MTP in contact with said OTP.

3. The roller according to claim 2, wherein:

said portion of said MTP having a tapered shape has a taper angle in a range of approximately between 5°–45°;

said cylindrical portion of said MTP has a predetermined length in a range of approximately between 2.0 mm–6.0 mm; and said first surface and said second surface of said MTP are separated by a distance in a range of approximately between 12 mm–16 mm.

4. The roller according to claim 1, wherein said OTP has an axial profile that comprises a portion having a cylindrical shape of a predetermined length in the axial direction, and an extension in said axial direction away from said second surface of said MTP, said extension formed with a tapered shape, said portion of said OTP having a cylindrical shape having a diameter larger than said diameter of said cylindrical shape of said MTP, and said portion of said MTP having a tapered shape defined by a maximum diameter and a minimum diameter, said maximum diameter equal to said larger diameter of said cylindrical shape of said OTP, and said minimum diameter defining a perimeter of said second surface of said OTP.

5. The roller according to claim 4, wherein said ITP comprises a portion having a cylindrical shape, and wherein said portion of said ITP having a cylindrical shape has a diameter which is substantially the same as said diameter of said portion of said MTP having cylindrical shape.

6. A roller for use in an electrostatographic machine, said roller comprising: a mandrel supporting an inner sleeve member (ISM) and an outer sleeve member (OSM), said OSM covering said ISM, said ISM and said OSM being replaceable removable members, said mandrel having a first end and a second end, said first end operationally supported by a disconnectable supporting member, said disconnectable supporting member reversibly movable in an outward direction away from said first end with said second end connected in cantilever fashion to a frame member of said electrostatographic machine, said mandrel including:

(a) a sleeve-supporting member having a predetermined outer diameter, said predetermined outer diameter substantially constant along an operational length of said sleeve-supporting member, said ISM in non-adhesive gripping contact around said sleeve-supporting member, said OSM in non-adhesive gripping contact around said ISM, said sleeve-supporting member having a flat end surface facing in said outward direction;

(b) an inner termination plate (ITP) operationally secured to said sleeve-supporting member, said ITP having a flat inward surface facing in an inward direction towards said flat end surface of said sleeve-supporting member, said flat inward surface contacting said flat end surface of said sleeve-supporting member so as to form a first interface therebetween, said ITP further having a flat outward surface facing in said outward direction;

(c) a middle termination plate (MTP) connected to said ITP, said MTP having a plurality of radially-extending grooves formed in a planar surface thereof, said planar surface facing in said inward direction and contacting said flat outward surface of said ITP so as to form a second interface therebetween, said radially-extending grooves extending from an annular recess formed in said planar surface to a perimeter of said MTP, said second interface including said planar surface and said radially-extending grooves so as to cooperate to form a first annular chamber and a plurality of radially-extending air passageways connecting said first annular chamber and said perimeter of said MTP, said first annular chamber being connectable to a source of pressurized air, whereby a plurality of radially directed air streams are created at said perimeter of said MTP when pressurized air is introduced into said first annular chamber, said MTP further including a planar outward surface facing in said outward direction; and (d) an outer termination plate (OTP) operationally connected to said MTP, said OTP having a plurality of radially-extending grooves formed in an inward planar surface thereof, said inward planar surface facing in said inward direction and contacting said planar outward surface of said MTP so as to form a third interface therebetween, said radially-extending grooves of said OTP extending from an annular recess of said OTP, said annular recess of said OTP formed in said inward planar surface to a perimeter of said OTP, said third interface including said inward planar surface and said radially-extending grooves of said OTP so as to cooperate to form a second annular chamber and a plurality of radially-extending air passageways connecting said second annular chamber and said perimeter of said OTP, said second annular chamber being connectable to a source of pressurized air, whereby a plurality of radially directed air streams are created at said perimeter of said OTP when pressurized air is introduced into said second annular chamber, said OTP further including an outward planar surface located furthermost from said sleeve-supporting member and facing in said outward direction.

7. The roller according to claim 6, wherein:

said inner sleeve member (ISM) is an unreinforced tubular sleeve having no backing layer;

said outer sleeve member (OSM) is a reinforced tubular sleeve in operational non-adhesive gripping contact with said ISM;

said ISM comprises a compliant layer and a flexible thin hard protective overcoat layer, said compliant layer being in operational non-adhesive gripping contact with said sleeve-supporting member, said thin hard protective overcoat layer gripped by said outer sleeve member;

said ISM has a thickness in a range of approximately between 0.2 mm and 14 mm;

said ISM is stretchably deformable and grips said sleeve-supporting member with an interference of approximately 10 mm±5 mm; and said OSM grips said ISM with an interference of less than approximately 125 micrometers.

8. The roller according to claim 7, wherein:

said thickness of said inner sleeve member is 0.500 mm±0.005 mm; and said OSM grips said ISM with an interference of approximately 75 micrometers±25 micrometers.

9. The roller according to claim 6, wherein said inner termination plate (ITP) has an axial profile that comprises a portion having a cylindrical outer shape, said cylindrical outer shape having a certain axial length, said portion having a cylindrical outer shape provided with an extension in said outward direction, said extension formed as an adjoining portion with a tapered outer shape, said portion having a cylindrical outer shape operationally secured to said sleeve-supporting member, said cylindrical outer shape inclusive of said perimeter of said ITP, said portion having a cylindrical outer shape having a diameter substantially equal to said predetermined outer diameter of said sleeve-supporting member, said portion having a tapered outer shape defined by a maximum diameter and a minimum diameter, said maximum diameter substantially equal to said predetermined outer diameter of said sleeve-supporting member, and said minimum diameter defining a perimeter of said flat outward surface of said ITP in contact with said middle termination plate.

10. The roller according to claim 9, wherein said adjoining portion having a tapered outer shape of said inner termination plate is a conical taper having a taper angle in a range of approximately between 5°–45°.

11. The roller according to claim 10, wherein said taper angle is in a range of approximately between 10°–20°.

12. The roller according to claim 9, wherein:

said inner sleeve member (ISM) has an extension in said outward direction beyond said flat end surface of said sleeve-supporting member, said extension of said ISM intimately non-adhesively contacting substantially all of said axial length of said portion having a cylindrical outer shape, said extension continuing so as to pass over all of said tapered outer shape so as to form an enclosure;

said enclosure is defined by said ISM, by said tapered outer shape, and by said middle termination plate; and, said enclosure encloses terminations of said plurality of radially-extending air passageways connecting said first annular chamber and said perimeter of said middle termination plate.

13. The roller according to claim 6, wherein said middle termination plate (MTP) has an axial profile that comprises a portion having a cylindrical outer shape, said cylindrical outer shape having a certain axial length, said portion having a cylindrical outer shape provided with an extension in said outward direction, said extension formed as an adjoining portion with a tapered outer shape, said portion having a cylindrical outer shape operationally connected to said inner termination plate, said cylindrical outer shape inclusive of said perimeter of said MTP, said portion having a cylindrical outer shape having an outer diameter larger than said predetermined diameter of said sleeve-supporting member, said portion with a tapered outer shape defined by a maximum diameter and a minimum diameter, said maximum diameter substantially equal to said outer diameter being larger than said predetermined diameter of said sleeve-supporting member, and said minimum diameter defining a perimeter of said flat outward surface of said MTP in contact with said outer termination plate.

14. The roller according to claim 13, wherein:

said adjoining portion with a tapered outer shape of said middle termination plate (MTP) is a conical taper having a taper angle in a range of approximately between 5°–45°;

said portion having a cylindrical outer shape has an axial length in a range of approximately between 2.0 mm–6.0 mm;

said portion having a cylindrical outer shape has a diameter substantially equal to said predetermined outer diameter of said sleeve-supporting member; and said flat inward surface and said flat outward surface of said MTP are separated by a distance in a range of approximately between 12 mm–16 mm.

15. The roller according to claim 14, wherein said taper angle is in a range of approximately between 10°–20°.

16. The roller according to claim 13, wherein:

said inner sleeve member (ISM) has an extension in said outward direction beyond said flat end surface of said sleeve-supporting member, said extension covering all of said inner termination plate, said extension including an edge of said ISM, said extension continuing so as to intimately non-adhesively contact said middle termination plate over said axial length of said portion having a cylindrical outer shape, said extension of said ISM further continuing so as to form an overlapping portion snugly and non-adhesively gripping said tapered outer shape, said edge of said ISM located so as to leave unimpeded said plurality of radially directed air streams from said plurality of radially-extending air passageways connecting said second annular chamber and said perimeter of said outer termination plate, said edge defining a length measured along said tapered outer shape where said tapered outer shape is not covered by said overlapping portion;

said outer sleeve member extending over and covering all of said middle termination plate inclusive of said tapered outer shape and thereby forming an enclosure, said enclosure defined by said outer sleeve member, by said overlapping portion of said ISM, by said tapered outer shape where said tapered outer shape is not covered by said overlapping portion, and by said outer termination plate; and said enclosure encloses terminations of said plurality of radially-extending air passageways connecting said second annular chamber and said perimeter of said outer termination plate.

17. The roller according to claim 16, wherein said length measured along said tapered outer shape where said tapered outer shape is not covered by said overlapping portion is in a range of approximately between 0.5–3 mm.

18. The roller according to claim 17, wherein said length measured along said tapered outer shape where said tapered outer shape is not covered by said overlapping portion is approximately 1 mm.

19. The roller according to claim 6, wherein said outer termination plate (OTP) has an axial profile that comprises a portion having a cylindrical outer shape, said cylindrical outer shape defined by an outer diameter and a certain axial length, said portion having a cylindrical outer shape provided with an extension in said outward direction, said extension formed as an adjoining portion with a tapered outer shape, said portion having a cylindrical outer shape of said OTP operationally connected to said middle termination plate (MTP), said cylindrical outer shape inclusive of said perimeter of said OTP, said outer diameter of said OTP larger than said outer diameter of said portion having cylindrical outer shape of said MTP, said portion with a tapered outer shape defined by a maximum diameter and a minimum diameter, said maximum diameter substantially equal to said outer diameter of said cylindrical outer shape of said OTP, said minimum diameter defining a perimeter of said outward planar surface located furthermost from said sleeve-supporting member, and said outer sleeve member (OSM) having an edge located such that said OSM substantially covers said portion having a cylindrical outer shape.

20. The roller according to claim 19, wherein said inner sleeve member (ISM) has a certain thickness, wherein said adjoining portion with a tapered outer shape of said outer termination plate (OTP) is a conical taper having a taper angle in a range of approximately between 1.5°–15°, wherein said portion having a cylindrical outer shape of said OTP has an axial length in a range of approximately between 3.5 mm–6.0 mm, wherein said outer diameter of said cylindrical outer shape of said OTP exceeds said outer diameter of said portion having cylindrical outer shape of said middle termination plate by a known amount, and said known amount equal to a sum of twice said certain thickness of said ISM plus a dimension represented by the symbol Δ.

21. The roller according to claim 20, wherein said axial length of said OTP is in a range of approximately between 4.0 mm–5.0 mm, wherein said taper angle is approximately 5°±2°, and wherein said dimension represented by the symbol Δ is approximately 20 micrometers±10 micrometers.

22. The roller according to claim 19, wherein said inner termination plate (ITP) comprises a portion having a cylindrical outer shape, and wherein said portion having a cylindrical outer shape of said ITP has an outer diameter which is substantially the same as said outer diameter of said portion having cylindrical outer shape of said middle termination plate.

23. The roller according to claim 6, wherein said ITP has an axial profile that comprises a portion having a cylindrical shape of a predetermined length in the axial direction, and an extension in said axial direction away from said first end surface of said sleeve-supporting mandrel, said extension formed with a tapered shape, said portion of said ITP having a cylindrical shape having a diameter substantially equal to said predetermined diameter of said sleeve-supporting mandrel, and said portion of said ITP having a tapered shape defined by a maximum diameter and a minimum diameter, said maximum diameter substantially equal to said predetermined diameter of said sleeve-supporting mandrel, and said minimum diameter defining a perimeter of said second surface of said ITP in contact with said MTP.

24. The roller according to claim 23, wherein said portion of said ITP having a tapered shape has a taper angle in a range of approximately between 5°–45°.

* * * * *